US009145733B2

(12) United States Patent
Worthington et al.

(10) Patent No.: US 9,145,733 B2
(45) Date of Patent: Sep. 29, 2015

(54) ADJUSTABLE LADDERS AND RELATED COMPONENTS

(71) Applicant: Wing Enterprises, Incorporated, Springville, UT (US)

(72) Inventors: Gary Landon Worthington, Moorpark, CA (US); Gary M. Jonas, Springville, UT (US); Sean R. Peterson, Santaquin, UT (US); N. Ryan Moss, Mapleton, UT (US); Benjamin K. Jackson, Santaquin, UT (US)

(73) Assignee: Wing Enterprises, Inc., Springville, UT (US)

( * ) Notice: Subject to any disclaimer, the term of this patent is extended or adjusted under 35 U.S.C. 154(b) by 0 days.

(21) Appl. No.: 14/162,992

(22) Filed: Jan. 24, 2014

(65) Prior Publication Data

US 2014/0202793 A1 Jul. 24, 2014

Related U.S. Application Data

(60) Provisional application No. 61/756,168, filed on Jan. 24, 2013, provisional application No. 61/828,000, filed on May 28, 2013.

(51) Int. Cl.
*E06C 7/44* (2006.01)
*E06C 7/42* (2006.01)

(52) U.S. Cl.
CPC .. *E06C 7/44* (2013.01); *E06C 7/423* (2013.01)

(58) Field of Classification Search
CPC ..... E06C 7/423; E06C 7/44; E05C 19/008
See application file for complete search history.

(56) References Cited

U.S. PATENT DOCUMENTS 546,379 A * 9/1895 Colton ..... 292/306
1,151,809 A * 8/1915 Morgan ..... 182/180.3
1,314,719 A 9/1919 Townsend
1,385,319 A * 7/1921 Enke ..... 182/172

(Continued)

FOREIGN PATENT DOCUMENTS

DE 19802741 A1 7/1999
FR 2701058 8/1994

(Continued)

OTHER PUBLICATIONS

N. Ryan Moss, U.S. Appl. No. 61/874,882, Sep. 6, 2013.

(Continued)

*Primary Examiner* — Alvin Chin-Shue
(74) *Attorney, Agent, or Firm* — Holland & Hart, LLP

(57) ABSTRACT

Adjustable ladders may include a pair of side rails having a plurality of rungs extending therebetween, and a pair of adjustable legs associated with the side rails. A pair of swing arms may include a first end pivotally coupled with a side rail, or a bracket associated with the side rail, as well as a second end pivotally coupled with an adjustable leg. The swing arm may be configured as a nonlinear structure. In one embodiment, the swing arm may include a first section that extends from a second section at a defined angle. The first and second sections may exhibit different lengths. Adjustment mechanisms may be pivotally coupled with an upper end of the adjustable legs. In one embodiment, the adjustment mechanisms may be configured such that, when actuated, they may be displaced in one direction while resisting displacement in a second, opposite direction.

12 Claims, 9 Drawing Sheets

(56) References Cited

U.S. PATENT DOCUMENTS

| | | | | | |
|---|---|---|---|---|---|
| 1,399,105 | A | * | 12/1921 | Cozens | 292/306 |
| 2,767,898 | A | | 10/1956 | Cramer | |
| 2,885,133 | A | | 5/1959 | Nelson | |
| 3,025,926 | A | * | 3/1962 | Vives | 182/201 |
| 3,933,221 | A | | 1/1976 | Sorenson | |
| 4,011,926 | A | * | 3/1977 | Larson et al. | 182/107 |
| 4,147,231 | A | | 4/1979 | Chantler et al. | |
| 4,182,431 | A | | 1/1980 | Wing et al. | |
| 4,244,446 | A | | 1/1981 | Mair | |
| 4,519,477 | A | * | 5/1985 | Ralston | 182/107 |
| 4,569,419 | A | * | 2/1986 | Stoltz | 182/160 |
| 4,632,220 | A | | 12/1986 | Murrell | |
| 5,267,631 | A | | 12/1993 | Mendel | |
| 5,273,133 | A | | 12/1993 | Thocher et al. | |
| 5,370,203 | A | | 12/1994 | Kiska | |
| 5,590,739 | A | | 1/1997 | High et al. | |
| 5,595,410 | A | * | 1/1997 | Wilson et al. | 292/306 |
| 5,845,744 | A | | 12/1998 | Beck et al. | |
| 6,336,521 | B1 | | 1/2002 | Dennis | |
| 6,959,785 | B1 | | 11/2005 | Chilton | |
| 7,093,690 | B2 | | 8/2006 | Swann | |
| 7,216,742 | B2 | | 5/2007 | Spengler | |
| 8,186,481 | B2 | | 5/2012 | Moss et al. | |
| 8,365,865 | B2 | | 2/2013 | Moss et al. | |
| 2009/0107765 | A1 | | 4/2009 | Germond | |

FOREIGN PATENT DOCUMENTS

| | | | |
|---|---|---|---|
| GB | 1524 | | 0/1910 |
| GB | 586854 | | 4/1947 |
| GB | 2042041 | | 9/1980 |
| GB | 2372532 | A | 8/2002 |
| GB | 2381554 | A | 5/2003 |
| GB | 2 388 868 | | 11/2003 |
| JP | 2004353266 | A | 12/2004 |
| KR | 2020100008259 | U | 8/2010 |

OTHER PUBLICATIONS

PCT International Search Report for PCT International Patent Application No. PCT/US2014/012980, mailed May 13, 2014.

English Abstract and Machine Translation of DE19802741. Jul. 29, 1999.

English Abstract and Machine Translation of FR2701058. Aug. 5, 1994.

* cited by examiner

ADJUSTABLE LADDERS AND RELATED COMPONENTS

CROSS-REFERENCE TO RELATED APPLICATIONS

The present application claims the benefit of U.S. Provisional Application No. 61/756,168, filed Jan. 24, 2013, and U.S. Provisional Application No. 61/828,000, filed May 28, 2013, the disclosures of each of which are incorporated by reference herein in their entireties.

TECHNICAL FIELD

The present invention relates generally to ladders and, more particularly, to ladders having components and features to provide selective adjustability as well as methods of making and using such ladders.

BACKGROUND

Ladders are conventionally utilized to provide a user thereof with improved access to elevated locations that might otherwise be inaccessible. Ladders come in many shapes and sizes, such as straight ladders, extension ladders, stepladders, and combination step and extension ladders. So-called combination ladders (sometimes referred to as articulating ladders) may incorporate, in a single ladder, many of the benefits of multiple ladder designs.

Straight ladders, extension ladders or combination ladders (when configured in an "extension" state or condition), are ladders that are conventionally positioned against an elevated surface, such as a wall or the edge of a roof, to support the ladder at a desired angle. A user then ascends the ladder to obtain access to an elevated area, such as to an upper area of the wall or access to the roof. A pair of feet or pads, one being coupled to the bottom of each side rail, is conventionally used to engage the ground, a floor or some other supporting surface.

Step ladders and combination ladders (when configured as a step ladder) are generally considered to be self supporting in that they include a first rail assembly which includes steps or rungs that is coupled to a second rail assembly or other support structure. The first and second rail assemblies are typically positioned at an acute angle relative to each other so that there are multiple feet or support members—at least three, but typically four—to support the ladder in a free standing position. Thus, the ladder may be used without the need to lean the ladder against a wall or other vertical support structure.

While the size and configuration of ladders may vary considerably, the rails of such ladders are conventionally spaced apart approximately 16 to 18 inches. In some applications, such as when the ladder is very tall, it may become desirable to have the feet spaced apart a greater distance to provide a widened footprint and improve stability. Such may also be the case regardless of the type of ladder (e.g., extension ladder or step ladder). Additionally, it is oftentimes desirable to use a ladder in a location where the ground or other supporting surface is not level. Positioning the ladder on such an uneven support surface, without taking further action, results in the ladder ascending at an undesirable lateral angle (i.e., so that the rungs or steps are not level) and likely makes use of the ladder unsafe.

There have been various efforts to remedy such issues with conventional ladders. For example, various embodiments of leg levelers—accessories that attach to the bottom portion of a ladder's rails—have been utilized to compensate for uneven surfaces by "extending" the length of the rail. Additionally, various embodiments of ladder stabilizers have been utilized wherein additional structural components are coupled to the ladder rails to alter the "footprint" of the ladder, typically making the footprint wider, in an effort to improve the stability to such ladders.

However, such efforts to provide additional stability to ladders have also had drawbacks. Often, leg levelers and stabilizers are provided as aftermarket items and are attached to the ladder by an end user. Such installation may not always be done with the appropriate care and attention. Additionally, such attachments or accessories are often intended to be removed after use meaning that they may be lacking in their structural integrity in their coupling with the ladder.

There is a continuing desire in the industry to provide improved functionality of ladders while maintaining or improving the safety and stability of such ladders. Thus, it would be advantageous to provide ladders with adjustable components that enable a ladder to be used on a variety of support surfaces while also perhaps providing enhanced stability. It would also be advantageous to provide methods related to the manufacture and use such ladders.

BRIEF SUMMARY OF THE INVENTION

In accordance with certain aspects of the invention, adjustable ladders and related components. In one particular aspect, a ladder is provided that includes a pair of spaced apart rails and a plurality of rungs extending between and coupled to the pair of spaced apart rails. The ladder additionally includes pair of adjustable legs, each adjustable leg slidably being coupled with one of the pair of spaced apart rails. A pair of brackets are configured such that each bracket is coupled to one of the pair of spaced apart rails. The ladder further includes a pair of swing arms, each swing arm having a first end pivotally coupled to one of the pair of brackets and a second end pivotally coupled with one of the pair of adjustable legs, wherein each swing arm exhibits a nonlinear geometry between its first end and its second end.

In accordance with one embodiment, each swing arm includes a first section and a second section, the first end extending from the second section at a defined angle less than 180°.

In accordance with one embodiment, the first section includes the first end, the second section includes the second end, and wherein the first section exhibits a first length and the second section exhibits a second length that is greater than the first length.

In accordance with one embodiment, a ratio of the second length to the first length is at least approximately 2:1.

In accordance with one embodiment, the defined angle is approximately 100° to approximately 140°.

In one embodiment, a location of the pivotal coupling of each swing arm and its associated bracket is positioned laterally between the pair of spaced apart rails. Additionally, the location of the pivotal coupling of each swing arm and its associated bracket may be positioned below a lowermost rung of the plurality of rungs.

In accordance with one embodiment, the ladder may further include a pair of adjustment mechanisms. Each adjustment mechanism may include a bar coupled with an associated rail of the pair of spaced apart rails, a body slidingly coupled with the bar, and an actuating mechanism. The actuating mechanism is configured to selectively enable sliding displacement of the body in a first direction while prohibiting sliding displacement in a second direction, the second direction being opposite of the first direction, and also selectively enable sliding displacement of the body in the second direction while prohibiting sliding displacement in the first direction. Each of the pair of adjustable legs includes a first end pivotally coupled with the body of an associated one of the pair of adjustment mechanisms.

In accordance with one embodiment, the ladder further includes a pair of feet, each foot being coupled to a second end of one of the pair of adjustable legs.

In accordance with one embodiment, the actuating mechanism includes a first set of engagement plates and a first biasing member located and configured to bias the first set of engagement plates substantially in the first direction into engagement with the bar.

In accordance with one embodiment, the actuating mechanism includes a second set of engagement plates and a second biasing member located and configured to bias the second set of engagement plates substantially in the second direction into engagement with the bar.

In one embodiment, the actuating mechanism includes an actuating structure configured to selectively displace at least one of the first set of engagement plates and the second set of engagement plates such that they are disengaged from the bar. The actuating structure may further be configured to selectively displace both the first set of engagement plates and the second set of engagement plates such that they are disengaged from the bar at the same time.

In accordance with one embodiment, the bar includes a longitudinal edge having a plurality of engagement features formed thereon.

In one embodiment, the ladder further comprises a second pair of spaced apart rails and a second plurality of rungs extending between and coupled to the second pair of spaced apart rails.

In accordance with another aspect of the invention, a ladder is provided that includes a pair of spaced apart rails, a plurality of rungs extending between and coupled to the pair of spaced apart rails and a pair of adjustment mechanisms. Each adjustment mechanism includes a bar coupled with an associated rail of the pair of spaced apart rails, a body slidingly coupled with the bar, and an actuating mechanism. The actuating mechanism is configured to selectively enable sliding displacement of the body in a first direction while prohibiting sliding displacement in a second direction, the second direction being opposite of the first direction, and also selectively enable sliding displacement of the body in the second direction while prohibiting sliding displacement in the first direction. The ladder also includes a pair of adjustable legs, each leg having a first end pivotally coupled with the body of an associated one of the pair of adjustment mechanisms.

In accordance with one embodiment, the actuating mechanism includes a first set of engagement plates and a first biasing member located and configured to bias the first set of engagement plates substantially in the first direction into engagement with the bar.

In accordance with one embodiment, the actuating mechanism includes a second set of engagement plates and a second biasing member located and configured to bias the second set of engagement plates substantially in the second direction into engagement with the bar.

In accordance with one embodiment, the actuating mechanism includes an actuating structure configured to selectively displace at least one of the first set of engagement plates and the second set of engagement plates such that they are disengaged from the bar. In one embodiment, the actuating structure is configured to selectively displace both the first set of engagement plates and the second set of engagement plates such that they are disengaged from the bar at the same time.

Features of any of the embodiments described herein may be combined with features of other embodiments without limitation.

BRIEF DESCRIPTION OF THE DRAWINGS

The foregoing and other advantages of the invention will become apparent upon reading the following detailed description and upon reference to the drawings in which.

DETAILED DESCRIPTION OF THE EMBODIMENT(S)

Figure 1:
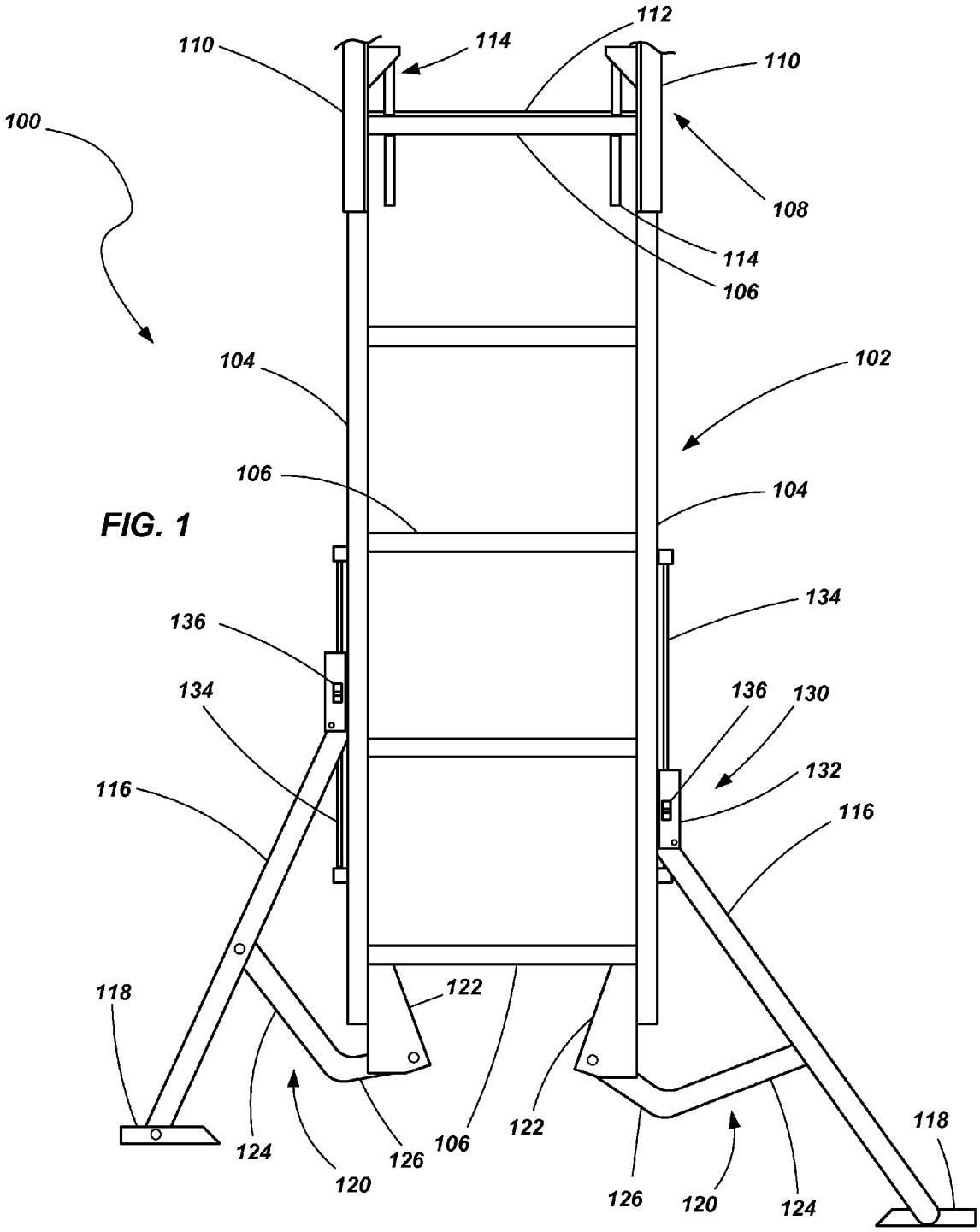
FIG. 1 is a front view of a ladder according to an embodiment of the present invention.
Figure 2:
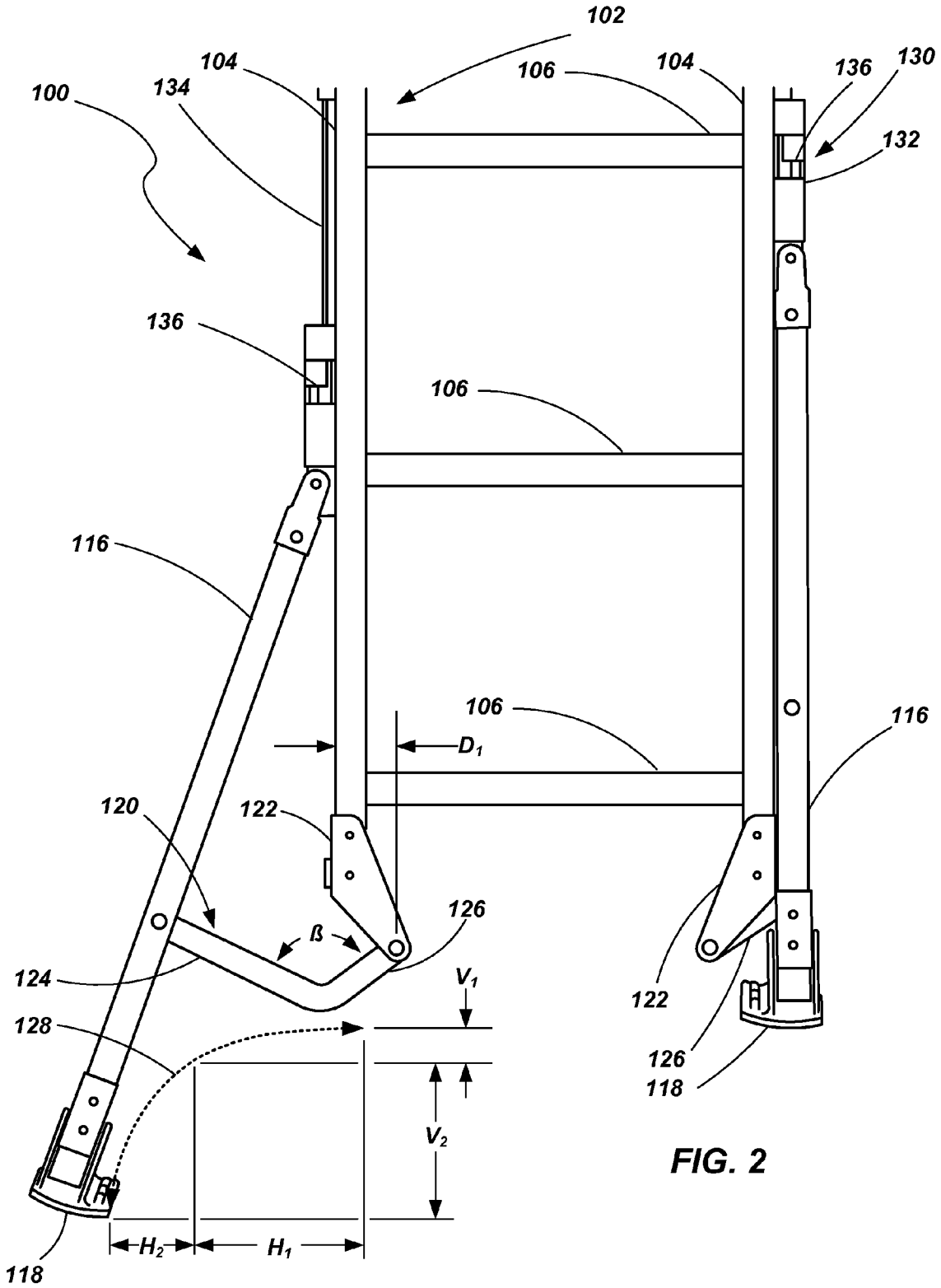
FIG. 2 is a front view of the ladder in FIG. 1 with various components in different positions or states.

Referring to FIGS. 1 and 2, a ladder 100 is shown in accordance with an embodiment of the present invention. The ladder 100 includes a first assembly 102 having a pair of spaced apart rails 104 and a plurality of rungs 106 extending between, and coupled to, the rails 104. The rungs 106 are substantially evenly spaced, substantially parallel to one another, and are configured to be substantially level when the ladder 100 is in an orientation of intended use, so that they may be used as "steps" for a user to ascend the ladder 100 as will be appreciated by those of ordinary skill in the art.

The ladder 100 shown in FIGS. 1 and 2 is configured as an extension ladder and also includes a second assembly 108 (see, e.g., FIG. 1) having a pair of spaced apart rails 110 and a plurality of rungs 112 extending between, and coupled to, the rails 110. The first assembly 102 and the second assembly 108 may be slidably coupled to one another such that the second assembly 108 may be selectively displaced relative to the first assembly 102 to effectively alter the height of the ladder 100. An extension adjustment mechanism 114 may be coupled with the second assembly 108 and interact with the first assembly 102 to enable the selective displacement between the two assemblies 102 and 108 and thereby alter the height of the ladder 100. The relationship and interaction of the first assembly 102, the second assembly 108 and the extension adjustment mechanism 114 in an extension ladder are known by those of ordinary skill in the art and need not be described in further detail herein. It is also noted that, while the embodiment described herein is shown and described as an extension ladder, the present invention embraces additional embodiments including, for example, straight ladders, step ladders and combination ladders (sometimes referred to as articulating ladders).

The first and second assemblies 102 and 108 may be formed of a variety of materials and by way of a variety of manufacturing techniques. For example, in one embodiment, the rails 104 and 110 may be formed of a composite material, such as fiberglass, while the rungs 106 and 112 and other structural components may be formed of aluminum or an aluminum alloy. In another embodiment, the rails 104 and 110 as well as the rungs 106 and 112 may be formed of an aluminum or aluminum alloy. In other embodiments, the assemblies 102 and 108 (and their various components) may be formed of other materials including other composites, plastics, polymers, metals and metal alloys.

An adjustable leg 116 is associated with each rail 104 of the first assembly 102. The adjustable leg 116 is slidably coupled to its associated rail 104 and may include a foot 118 or other support member which may be coupled to the lower end thereof. A swing arm 120 has a first end that is pivotally coupled with and associated adjustable leg 116 at a location between the upper and lower ends of the adjustable leg 116. A second end of each swing arm 120 is pivotally coupled with an associated side rail 104, or with a bracket 122 that is associated with the first assembly 102 (e.g., coupled to an associated rail and/or rung). In the embodiment shown in FIGS. 1 and 2, the location of the pivot (connecting the swing arm 120 and the bracket 122) is positioned laterally inward of the associated side rail 104 (or between the two side rails 104) and beneath the lowermost rung when viewing the ladder in an orientation of intended use such as shown in FIGS. 1 and 2.

The swing arms 120 may be configured as a non-linear member. For example, in one embodiment, each of the swing arms 120 may be configured to include a first section 124 and a second, shorter section 126 extending from the first section 124 at a desired angle β relative to first section 124. In one example, the angle β may be between approximately 60° and approximately 179°. In another embodiment, the angle β may preferably be between approximately 100° and approximately 140°. In another embodiment, the angle β may more preferably be between approximately 115° and 125°.

Generally speaking, in the embodiment shown in FIGS. 1 and 2, the second section 126 may extend at an obtuse angle relative to the first section 124. In other embodiments, the swing arm 120 may be configured as a curved member rather than two or more sections having an angular arrangement. In such a case, the curved member need not exhibit a common radius throughout its extent. Rather, the curved member may exhibit sections having different radii.

It is noted that FIG. 1 shows one adjustable leg 116 at a first position, and the other adjustable leg 116 at a second position. More specifically, the adjustable leg 116 shown on the right side of the drawing is positioned at a first angle (relative to its rail 104), with the associated foot 118 being positioned at a first distance from the lowermost rung 106 of the first assembly 102. On the other hand, the adjustable leg 116 shown on the left side of the drawing is positioned at a second angle (relative to its rail 104), which is less than the first angle, and with its associated foot 118 being positioned at a second distance from the lowermost rung, the second distance being less than the first distance. The adjustable legs 116 are adjustable independent of one another and may be positioned at any of a range of positions, including a position where the adjustable arm is substantially parallel to its associated rail (positioned adjacent the rail) with its associated foot 118 being closer to the lowermost rung 106 than either of the positions shown in FIG. 1. Thus, as the upper end of an adjustable leg 116 slides along the length of a rail 104, the swing arm 120 rotates and causes the angle of the adjustable leg 116 to change, the associated foot 118 simultaneously changing its distance from the lower most rung 106.

Referring briefly to FIG. 2, the adjustable leg 116 shown on the left is deployed at a desired position, while the adjustable leg 116 shown on the right is in a fully retracted position. While the ladder 100 may be used with the leg 116 in a fully retracted position, it is contemplated that such a position will be utilized more for purposes of storage and transportation of the ladder 100, making it smaller and more compact when not in use.

Considering the embodiment shown in FIGS. 1 and 2, the configuration of the first and second sections 124 and 126 of the swing arm 120, including their respective lengths, the angle at which they extend from one another, and their pivot locations relative to their associated rails 104 and adjustable legs 116, may be selected to effect a desired angular position of the adjustable legs 116 when the upper end of the adjustable legs is displaced along the length of their associated rails 104.

Further, such parameters may be selected provide a desired rate at which the foot 118 is displaced laterally away from its associated side rail 104 and a desired rate at which the foot is displaced vertically relative to the rungs 106 when the upper end of the adjustable leg 116 is displaced upwards or downwards along its associated side rail 104. The nonlinear configuration of the swing arm 120 permits the lateral displacement and the vertical displacement of the foot 118 to be controlled in a desired manner. For example, the components may be arranged such that when being displaced from a fully collapsed or stored state to a deployed state, the foot 118 is initially displaced primarily laterally, away from the side rail 104, in order to provide greater width and stability immediately, providing a curved pathway 128 of the foot 118 that is nonlinear and may be geometrically complex.

Thus in one example, initial displacement of the upper end of the adjustable leg 116 may result in a foot path having a lateral or horizontal displacement indicated by $H_1$ and a vertical displacement of $V_1$ as indicated in FIG. 2. Further displacement of the upper end of the adjustable leg 116 may then result in primarily vertical displacement of the foot 118 while the foot 118 remains within a "lateral zone." Thus in one example, further displacement of the upper end of the adjustable leg 116 may result in a foot path having a lateral or horizontal displacement indicated by $H_2$ and a vertical displacement of $V_2$ as indicated in FIG. 2. This enables the ladder to gain immediate stability with a broader base, while providing subsequent vertical adjustment while the foot 118 remains within a range of desired distances from the side rail 104.

In one particular example embodiment, the pivot location between the swing arm 120 and the bracket 122 may be positioned a distance $D_1$ approximately 2.25 and 2.5 inches inwardly from the outer surface of its associated side rail 104. The first section 124 of the swing arm 120 may be approximately 6.75 to 7.0 inches long and the second section 126 may be approximately 3.25 to 3.5 inches long and the angle β may be approximately 117°. Considered another way, the example embodiment includes a swing arm 120 where the length ratio of the first section 124 to the second section 126 may be approximately 2:1 or greater. Of course, other dimensions and configurations are contemplated and this example is not to be considered limiting in any sense.

Figure 3:
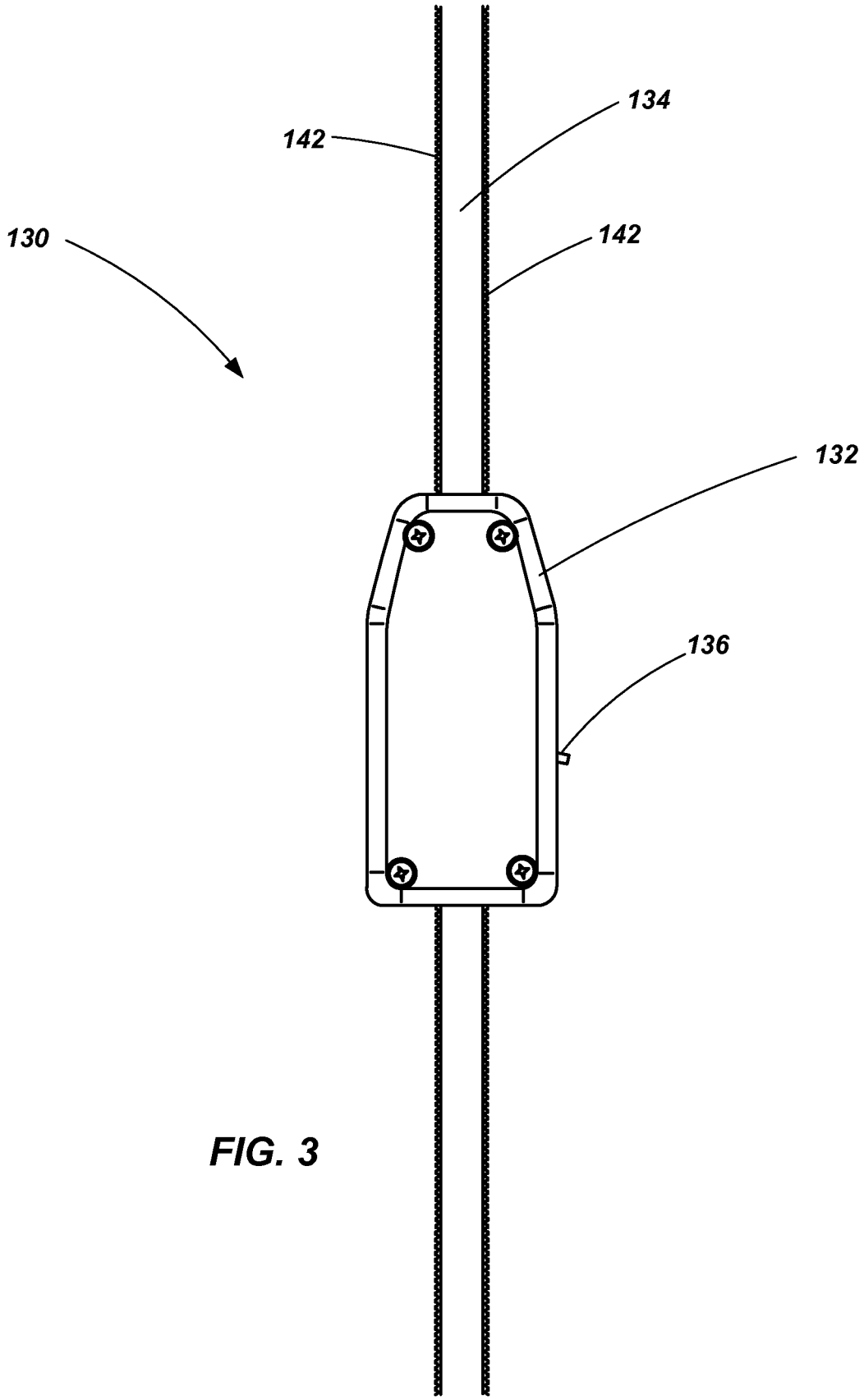
FIG. 3 is a front view of mechanism of the ladder shown in FIG. 1.

Referring to FIGS. 1 and 2 in association with FIG. 3, an adjustment mechanism 130 is associated with each adjustable leg 116 in order to effect the selective displacement of the upper end of the adjustable leg 116 relative to the rail 104. For example, the upper end of the adjustable leg 116 may be pivotally coupled to a sliding body 132 of the adjustment mechanism 130. The sliding body 132 may be slidably coupled to a rod or a bar 134 which is coupled to the rail 104 such that it is spaced apart from, but extends substantially parallel to, the rail 104. An actuator button 136 may be associated with the body 132 to selectively effect locking and release of the sliding body 132 relative to the bar 134 as will be discussed in further detail below. In one embodiment, the adjustment mechanism 130 may be configured such that sliding the actuator button 136 upwards (when in the intended operating orientation of the ladder, such as shown in FIG. 1,) enables the body 132 to slide upwards along the bar 134, but not downwards along the bar 134. Additionally, sliding the button 136 downwards enables a user to slide the body 132 downwards along the bar 134 but not upwards along the bar 134.

Such a configuration makes operation of the adjustable leg 116 more intuitive for a user of the ladder 100. For example, pushing the button 136 downwards to adjust the body 132 and, thus, the leg 116 and foot 118 downwards. In effecting such an adjustment, a user might have to hold or "lift up" on, for example, the first assembly 102 while the body 132 is slid downwards, resulting, ultimately, in the foot 118 being displaced generally downwards and outwards. Likewise, sliding the button 136 upwards enables a user to slide the body 132 and, thus, the adjustable leg 116 and foot 118 upwards.

It is noted that such a configuration may act as a safety mechanism as well. For example, if something falls on and inadvertently displaces the button 136 downwards, the sliding body 132 will not travel upwards relative to the bar 134 and rail 104. Inadvertent travel of the body 132 upwards relative to the bar 134 and rail 104 would, due to gravity, cause the rail 104 and rungs 106 to "fall" downwards and create an unstable situation for a user on the ladder 100.

Figure 4:
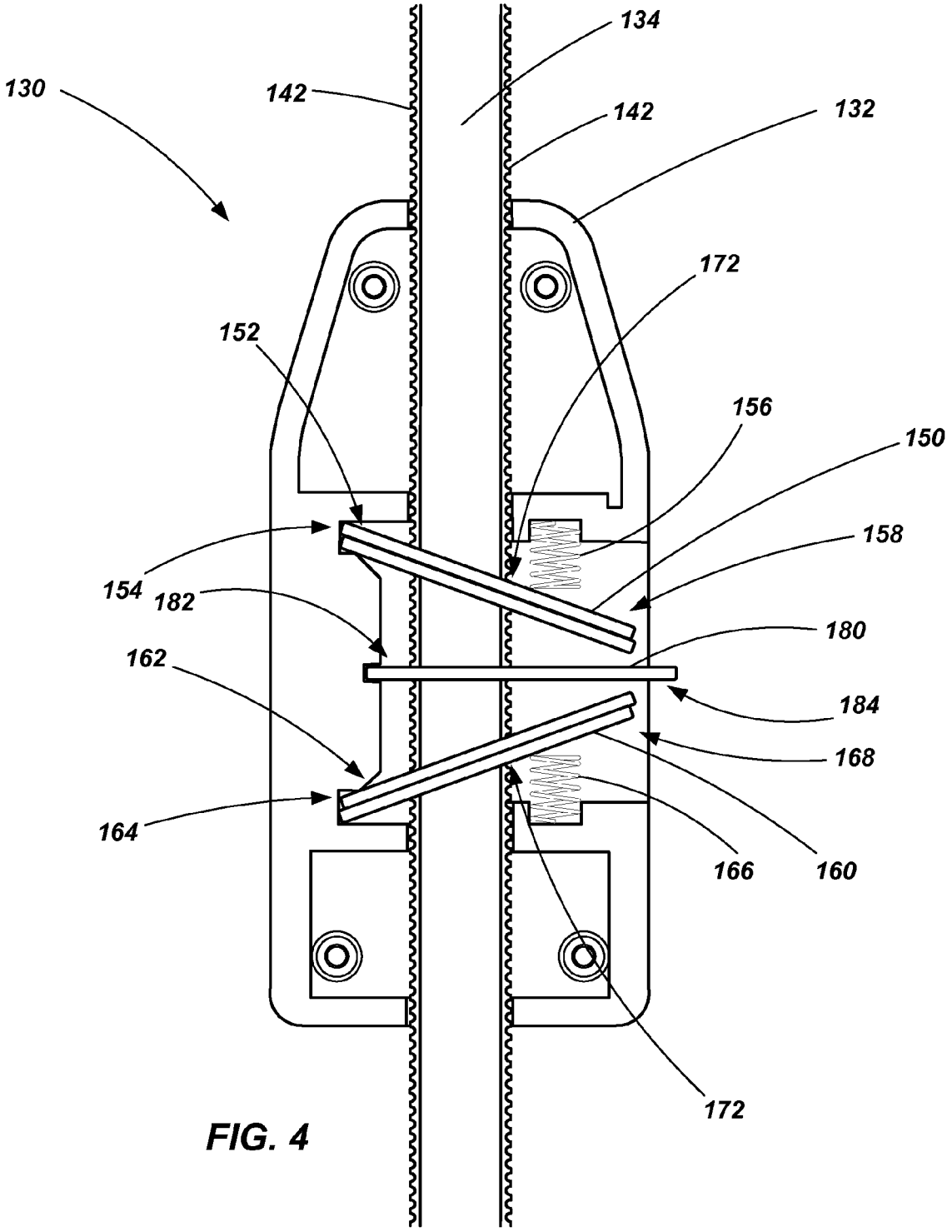
FIG. 4 shows the mechanism of FIG. 3 with a cover removed to reveal various internal components while in a neutral or fully locked state.

Referring now to FIG. 4, an adjustment mechanism 130 is shown in accordance with an embodiment of the present invention. It is noted that the adjustment mechanism 130 is shown in FIG. 4 with a cover associated with the body 132 removed to show the internal components. As seen in the various drawings, the bar 134 may include longitudinal edge surfaces 142 having frictional or traction surface features. For example, the surface features may include notches, knurling, an undulating surface or a roughened surface.

The adjustment mechanism 130 includes a first set of engagement plates 150 having a first end 152 positioned in a seat 154 formed within the body 132. A biasing member 156 that provides a biasing force between a surface of the body 132 and the engagement plates 150 such that the second end 158 of the engagement plates 150 are biased in a first direction (downward in the orientation shown in FIG. 4). The adjustment mechanism 130 includes a second set of engagement plates 160 having a first end 162 positioned in a seat 164 formed within the body 132. A biasing member 166 provides a biasing force between a surface of the body 132 and the engagement plates 160 such that the second end 168 of the engagement plates 160 are biased in a second direction, substantially opposite of the first direction (i.e., upward in the orientation shown in FIG. 4).

Figure 5:
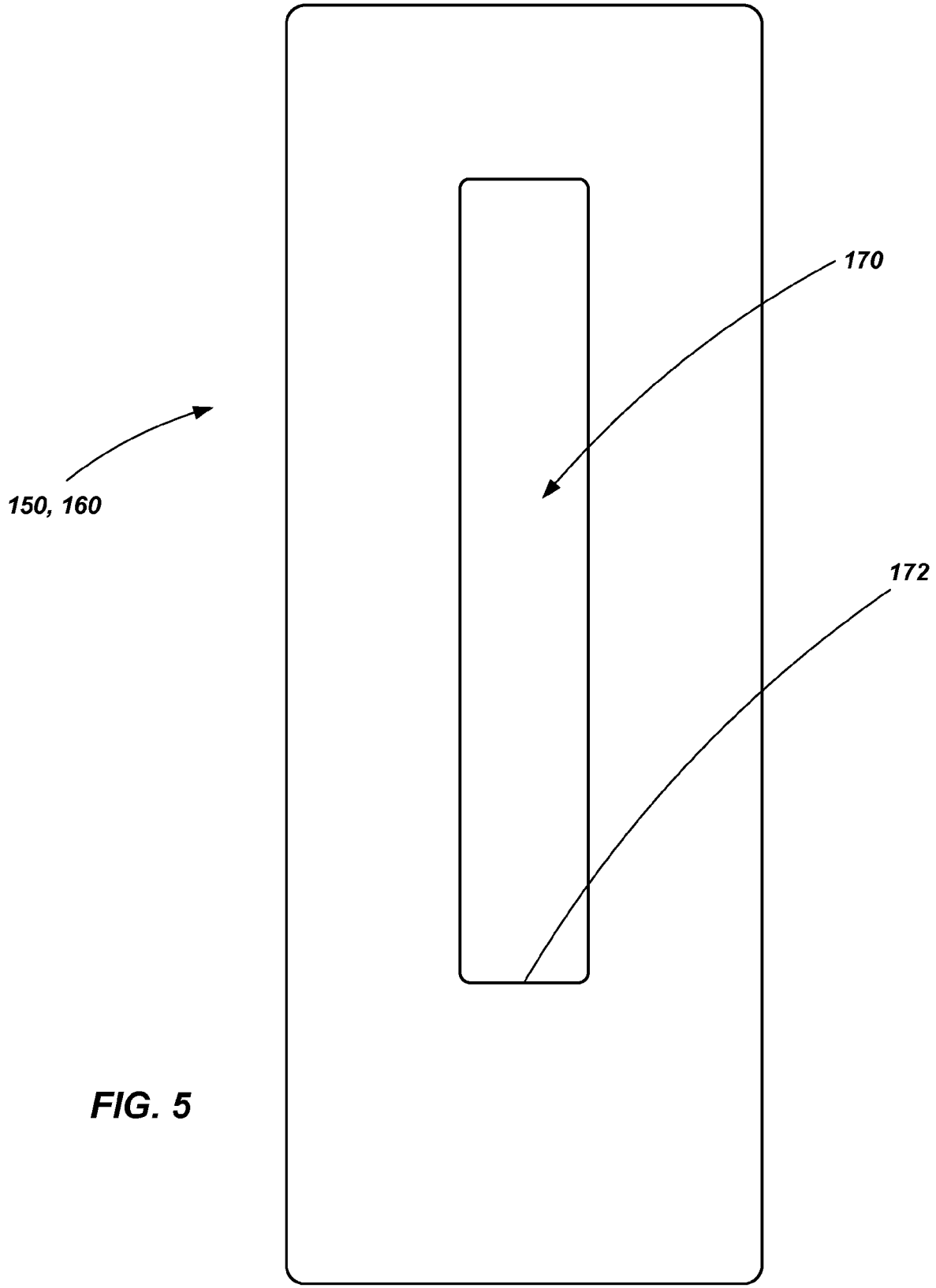
FIG. 5 is a top view of an internal component of an adjustment mechanism according to an embodiment of the invention.

Each of the engagement plates 150 and 160 include an opening 170 formed therein, as seen in FIG. 5. The opening 170 is sized and configured such that the rod or bar 134 extends through the openings of the various engagement plates 150 and 160. The opening 170 includes an engagement surface 172 that is configured to selectively engage and disengage a longitudinal edge surface 142 of the rod or bar 134 including the surface or traction features of the longitudinal edge if the bar 134 includes such.

Still referring to FIG. 4, the adjustment mechanism 130 includes an actuating plate 180 having a first end 182 pivotally seated or coupled with the body 132 and a second end 184 extending out of the body 132 for engagement with an actuating button 136 (not specifically shown in FIG. 4) or for use as the actuating button. The actuating plate 180 may include an opening through which the bar 134 extends, similar to engagement plates 150 and 160. However, the opening in the actuating plate 180 is not configured to engage a longitudinal edge surface of the bar 134. As depicted in FIG. 4, the adjustment mechanism 130 is in a neutral or completely locked state such that the body 132 can not slide in either direction along the bar 134. This is because the engagement surface 172 of the first set of engagement plates 150 is biased into engagement with a longitudinal edge surface 142 of the bar 134, preventing the body 132 from being displaced upwards along the bar 134 (in the orientation shown in FIG. 4), while the engagement surface 172 of the second set of engagement plates 160 is biased into engagement with the longitudinal edge surface 142 of the bar 134, preventing the body 132 from being displaced downwards along the bar 134 (in the orientation shown in FIG. 4).

Figure 6:
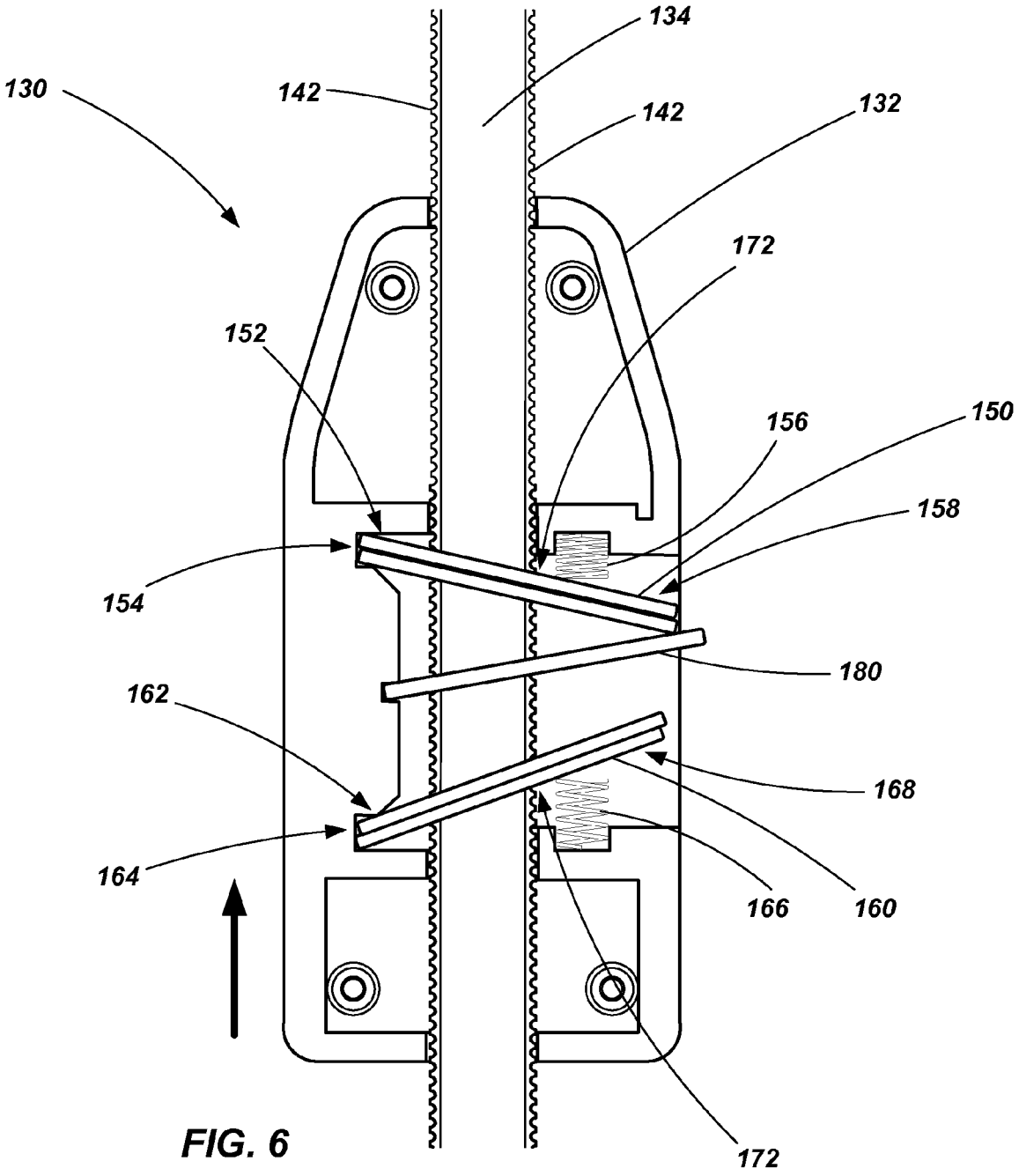
FIG. 6 shows the mechanism of FIG. 3 with a cover removed to reveal various internal components while in first actuated state.

Referring to FIG. 6, the adjustment mechanism 130 is shown with the actuation lever 180 displaced upwards, causing the first set of engagement plates 150 to be pivoted upward such that their engagement surfaces 172 are no longer engaged with longitudinal edge surface 142 of the bar 134. This enables the body 132 to slide upwards along the bar 134. The second set of engagement plates 160 permit the body 132 to slide upwards along the bar 134 because they do not "bite" into the longitudinal edge surface 142 of the bar when travelling in that direction. However, the second set of engagement plates 160 still prohibit the body 132 from being displaced downward along the bar 134 when in the state shown in FIG. 6.

Figure 7:
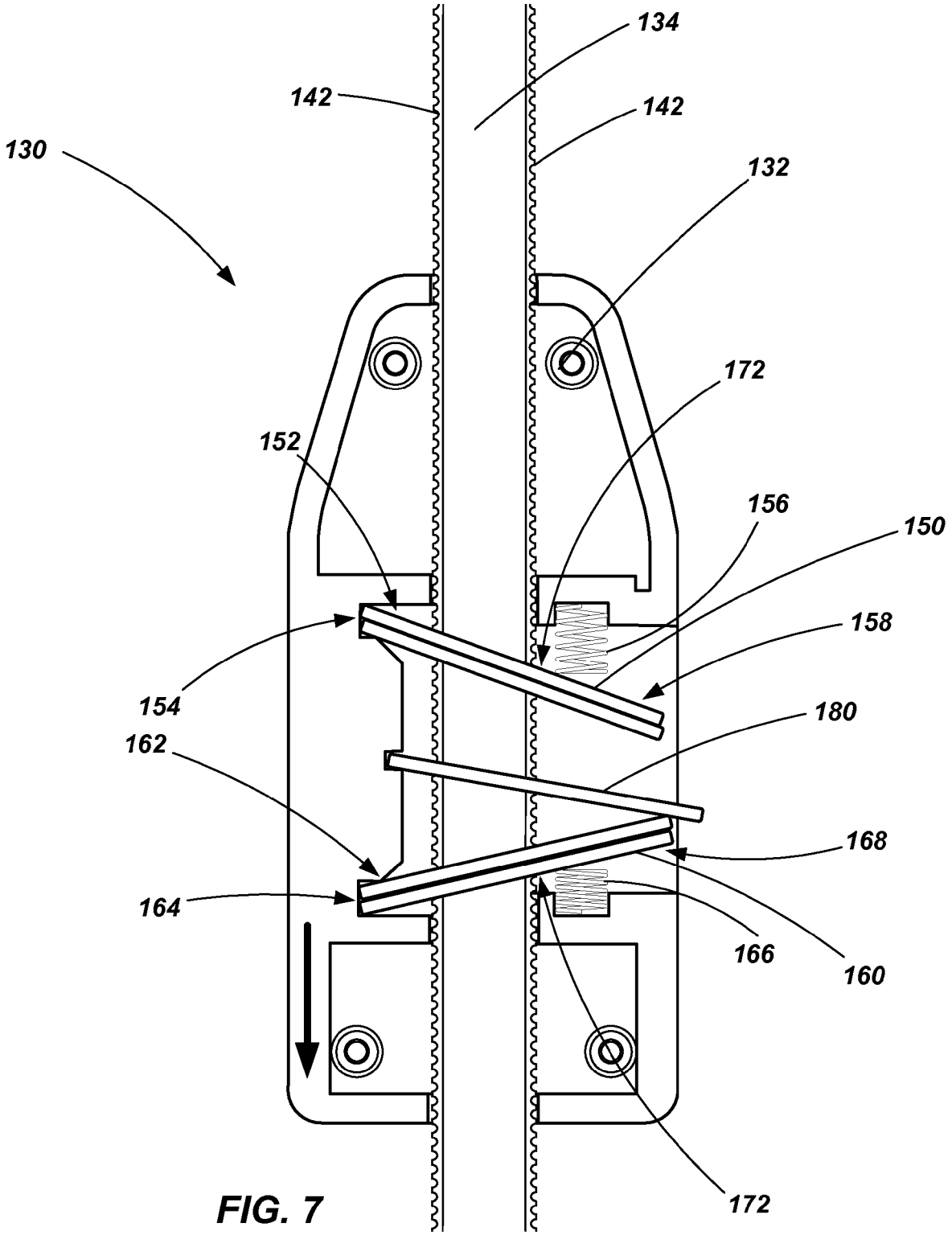
FIG. 7 shows the mechanism of FIG. 3 with a cover removed to reveal various internal components while in second actuated state.

Referring to FIG. 7, the adjustment mechanism 130 is shown with the actuation lever 180 displaced downwards, causing the second set of engagement plates 160 to be pivoted downward such that their engagement surfaces 172 are no longer engaged with longitudinal edge surface 142 of the bar 134. This enables the body 132 to slide downwards along the bar 134. The first set of engagement plates 150 permit the body 132 to slide downwards along the bar 134 because they do not "bite" into the longitudinal edge surface 142 of the bar 134 when the body 132 is travelling in that direction. However, the first set of engagement plates 150 still prohibit the body 132 from being displaced upward along the bar 134 when in the state shown in FIG. 7.

It is noted that the embodiment described herein contemplates a bar 134 that exhibits a substantially rectangular cross-section taken substantially transverse to the length thereof. However, other shapes are also contemplated including round, oval, square and other geometries. Also, while specific components, or a specific number of components are shown in the drawings, such should be considered as an example only and not limiting. For example, while the biasing member is shown as a coil spring, other biasing members may be used. Similarly, while the engagement plates are shown in sets of two, other numbers of plates may be used.

Figure 8:
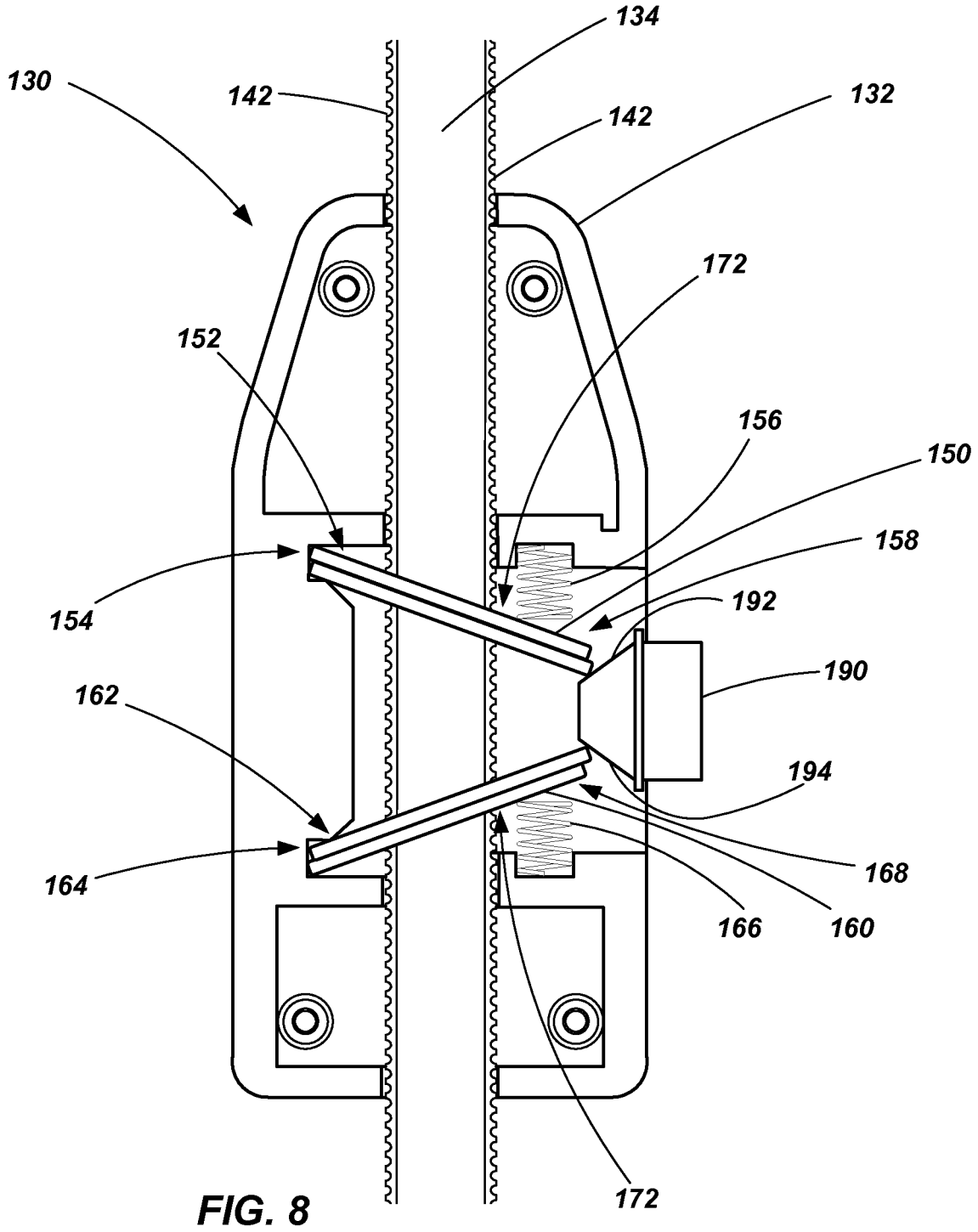
FIG. 8 shows a mechanism that may be used with a ladder in accordance with another embodiment of the invention.

Referring now to FIG. 8, an adjustment mechanism 136 is shown in accordance with another embodiment of the present invention. The adjustment mechanism 130 includes a first set of engagement plates 150 having a first end 152 positioned in a seat 154 formed within the body 132. A biasing member 156 that provides a biasing force between a surface of the body 132 and the engagement plates 150 such that the second end 158 of the engagement plates 150 are biased in a first direction (downward in the orientation shown in FIG. 8). The adjustment mechanism 130 includes a second set of engagement plates 160 having a first end 162 positioned in a seat 164 formed within the body 132. A biasing member 166 provides a biasing force between a surface of the body 132 and the engagement plates 160 such that the second end 168 of the engagement plates 160 are biased in a second direction, substantially opposite of the first direction (i.e., upward in the orientation shown in FIG. 8). Each of the engagement plates 150 and 160 may be configured such as described above with respect to FIG. 5.

The adjustment mechanism 130 includes an actuating button 190 or lever having a pair of angled surfaces 192 and 194 configured to abut or otherwise engage the second ends of the first set of engagement plates 150 and second set of engagement plates 160, respectively. As depicted in FIG. 8, the adjustment mechanism 130 is in a neutral or completely locked state such that the body 132 can not slide in either direction along the bar 134. This is because the engagement surface 172 of the first set of engagement plates 150 is biased into engagement with a longitudinal edge surface 142 of the bar 134, preventing the body 132 from being displaced upwards along the bar 134 (in the orientation shown in FIG. 8), while the engagement surface 172 of the second set of engagement plates 160 is biased into engagement with the longitudinal edge surface 142 of the bar 134, preventing the body 132 from being displaced downwards along the bar 134 (in the orientation shown in FIG. 8).

Figure 9:
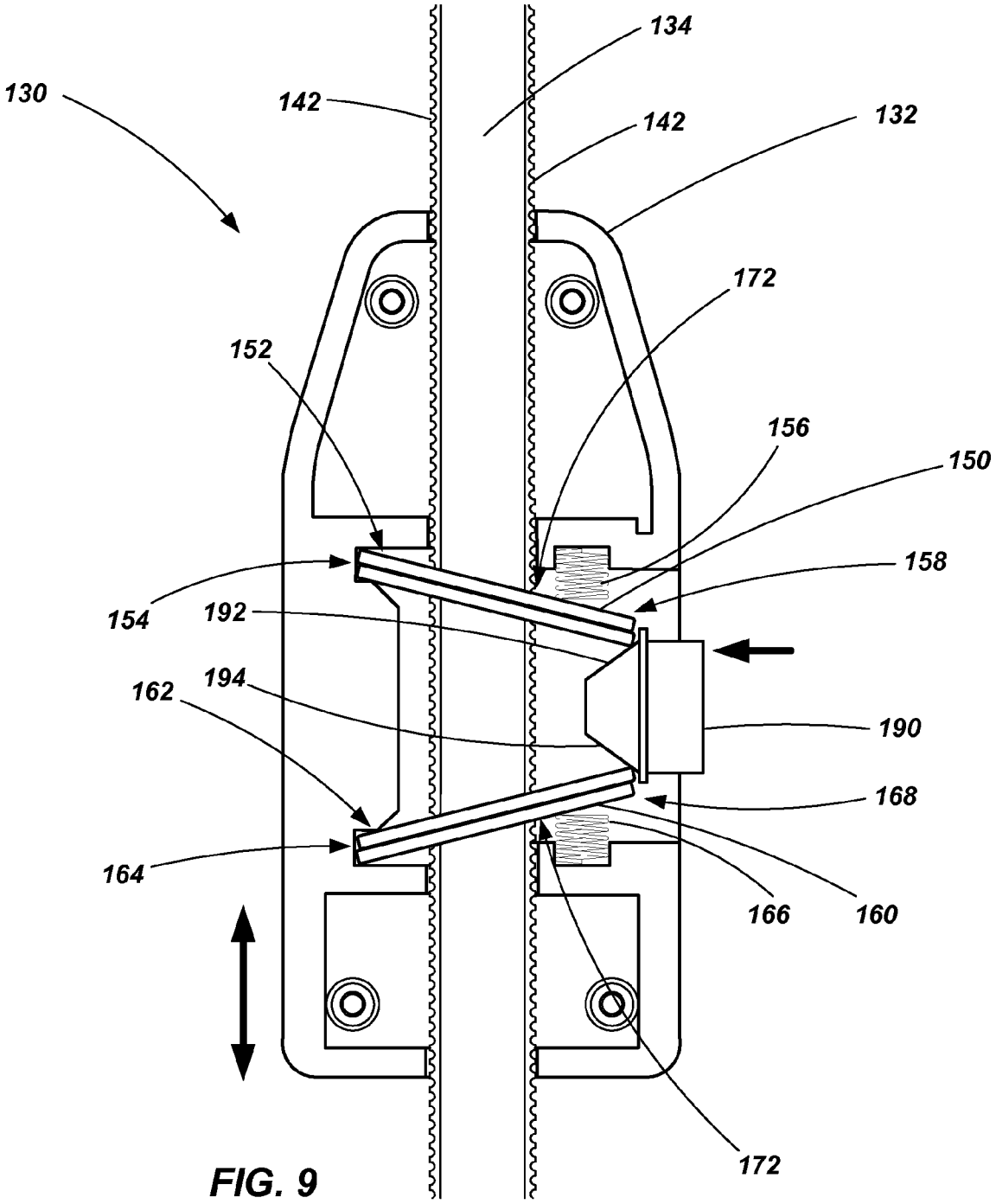
FIG. 9 shows the mechanism of FIG. 8 while in an actuated state.

Referring to FIG. 9, the actuating button 190 is depressed into the body 132 such that the angled surfaces 192 and 194 engaged and displace both the first and second sets of engagement plates 150 and 160 substantially simultaneously away from each other. This results in the engagement surfaces 172 (of both sets of engagement plates 150 and 160) disengaging the longitudinal edge surface 142 of the barn 134, enabling the body to slide in either direction (i.e., upwards or downwards) along the bar 134. Releasing the actuating button 190 allows the engagement plates 150 and 160 to return to their original, engaged position, such as shown in FIG. 8, so that the body 132 is again locked in position along the bar 134.

As previously noted, the adjustment mechanism may be used in conjunction with a variety of ladder types. For example, the adjustment mechanism and/or associated components (e.g., adjustable leg, swing arm, etc.) may be used in association with, or combined with components from, the ladder described in U.S. Pat. No. 8,365,865 (issued Feb. 5, 2013, entitled ADJUSTABLE LADDERS AND RELATED METHODS), the disclosure of which is incorporated by reference herein in its entirety. Additionally, such may be used in conjunction with a step ladder or with the types of ladders described in U.S. Pat. No. 8,186,481 (issued May 29, 2012, entitled LADDERS, LADDER COMPONENTS AND RELATED METHODS) or U.S. Pat. No. 4,182,431 (issued Jan. 8, 1980, entitled COMBINATION EXTENSION AND STEP LADDER RUNGS THEREFOR [sic]), the disclosures of which are incorporated by reference herein in their entireties.

Additionally, other adjustment mechanisms may be used to effect the selective positioning of the upper end of the adjustable arms along the length of the side rails. For example, additional examples of adjustment mechanisms that may be used in conjunction with the adjustable legs and associated swing arms include those described in U.S. Provisional Patent Application No. 61/874,882, filed on Sep. 6, 2013, entitled ADJUSTABLE LADDERS, LADDER COMPONENTS AND RELATED METHODS, the disclosure of which is incorporated by reference herein in its entirety.

Features and aspects of one embodiment may be combined with features and aspects of other embodiments without limitation. While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A ladder comprising:

a pair of spaced apart rails;

a plurality of rungs extending between and coupled to the pair of spaced apart rails;

a pair of adjustable legs, each adjustable leg slidably coupled with one of the pair of spaced apart rails;

a pair of brackets, each bracket being coupled to one of the pair of spaced apart rails;

a pair of swing arms, each swing arm having a first end pivotally coupled to one of the pair of brackets and a second end pivotally coupled with one of the pair of adjustable legs, wherein each swing arm exhibits a non-linear geometry between its first end and its second end;

wherein each swing arm includes a first section and a second section, the first section extending from the second section at a defined angle less than 180°, wherein the first section includes the first end, the second section includes the second end, and wherein the first section exhibits a first length and the second section exhibits a second length that is greater than the first length; and wherein a location of the pivotal coupling of each swing arm and its associated bracket is positioned laterally between the pair of spaced apart rails.

2. The ladder of claim 1, wherein a ratio of the second length to the first length is at least approximately 2:1.

3. The ladder of claim 2, wherein the defined angle is approximately 100° to approximately 140°.

4. The ladder of claim 1, wherein the location of the pivotal coupling of each swing arm and its associated bracket is positioned below a lowermost rung of the plurality of rungs.

5. The ladder of claim 1, further comprising:

a pair of adjustment mechanisms, each adjustment mechanism comprising:

a bar coupled with an associated rail of the pair of spaced apart rails;

a body slidingly coupled with the bar; and an actuating mechanism including a first set of engagement plates associated with the body and a first biasing member located and configured to bias the first set of engagement plates into engagement with the bar to prevent the body from moving in a first direction along a length of the bar;

wherein each of the pair of adjustable legs includes a first end pivotally coupled with the body of an associated one of the pair of adjustment mechanisms.

6. The ladder of claim 5, further comprising a pair of feet, each foot being coupled to a second end of one of the pair of adjustable legs.

7. The ladder of claim 5, wherein the actuating mechanism is configured to selectively enable sliding displacement of the body in the first direction while prohibiting sliding displacement in a second direction, the second direction being opposite of the first direction, and also selectively enable sliding displacement of the body in the second direction while prohibiting sliding displacement in the first direction.

8. The ladder of claim 5, wherein the actuating mechanism includes a second set of engagement plates associated with the body and a second biasing member located and configured to bias the second set of engagement plates into engagement with the bar to prevent the body from moving in a second direction along the length of the bar.

9. The ladder of claim 8, wherein the actuating mechanism includes an actuating structure configured to selectively displace at least one of the first set of engagement plates and the second set of engagement plates such that they are disengaged from the bar.

10. The ladder of claim 8, wherein the actuating structure is configured to selectively displace both the first set of engagement plates and the second set of engagement plates such that they are disengaged from the bar at the same time.

11. The ladder of claim 8, wherein the bar includes a longitudinal edge having a plurality of engagement features formed thereon, and wherein each of the first set of engagement plates and the second set of engagement plates engage at least one of the plurality of engagement features when engaged with the bar.

12. The ladder of claim 5, further comprising a second pair of spaced apart rails and a second plurality of rungs extending between and coupled to the second pair of spaced apart rails.

* * * * *